US007708616B2

(12) United States Patent
Phillips

(10) Patent No.: US 7,708,616 B2
(45) Date of Patent: May 4, 2010

(54) BALLOON DISPLAY SYSTEMS

(76) Inventor: Charles Phillips, 26 New York Ave., White Plains, NY (US) 10606

( * ) Notice: Subject to any disclaimer, the term of this patent is extended or adjusted under 35 U.S.C. 154(b) by 570 days.

(21) Appl. No.: 11/527,302

(22) Filed: Sep. 26, 2006

(65) Prior Publication Data

US 2008/0076322 A1 Mar. 27, 2008

(51) Int. Cl.
*A63H 27/10* (2006.01)

(52) U.S. Cl. ..... 446/220

(58) Field of Classification Search ..... 446/220, 446/221, 222, 223, 224, 225, 226
See application file for complete search history.

(56) References Cited

U.S. PATENT DOCUMENTS 3,108,396 A * 10/1963 Isidore Dorman ..... 446/220
3,267,604 A * 8/1966 Goldsmith ..... 446/222
4,145,838 A * 3/1979 Mason ..... 446/77
4,428,149 A * 1/1984 Brown ..... 446/222
4,881,916 A * 11/1989 Houser ..... 446/222
5,482,492 A * 1/1996 Becker ..... 446/224
5,938,154 A * 8/1999 Bartels ..... 248/176.1
6,167,924 B1 * 1/2001 Buckley et al. ..... 141/313
6,176,758 B1 * 1/2001 Wu ..... 446/224
6,192,917 B1 * 2/2001 Ramos Loza ..... 137/223
6,375,534 B1 * 4/2002 Burns ..... 446/220
6,892,772 B1 * 5/2005 Wang et al. ..... 141/313
2007/0049158 A1 * 3/2007 Chou ..... 446/220

* cited by examiner

*Primary Examiner*—John Ricci
(74) *Attorney, Agent, or Firm*—Kirschstein, et al.

(57) ABSTRACT

A balloon is connected to a cylindrical tube, and the resulting assembly is mounted on a container to serve as a decorative balloon display system.

23 Claims, 5 Drawing Sheets

FIG. 6
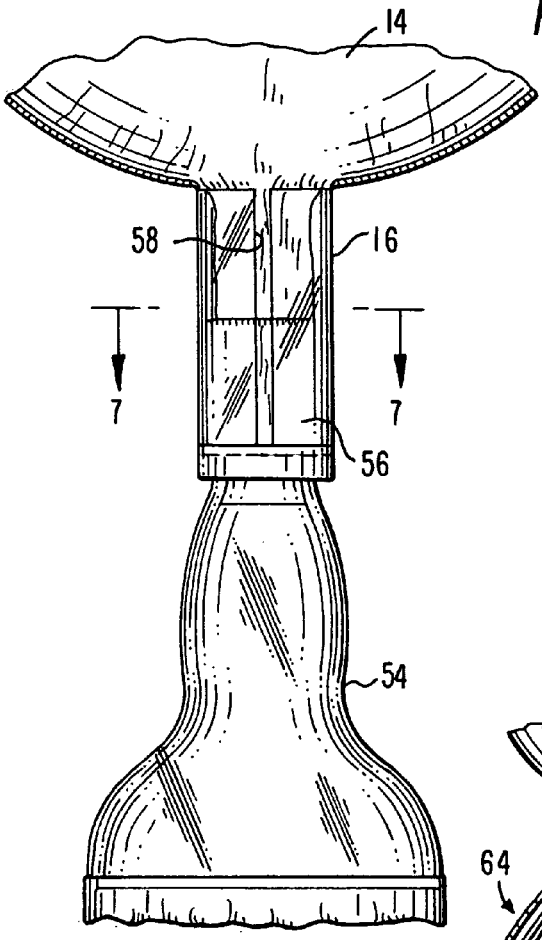
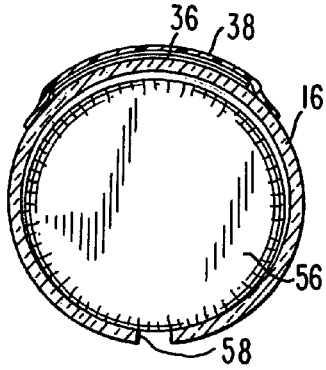
FIG. 7
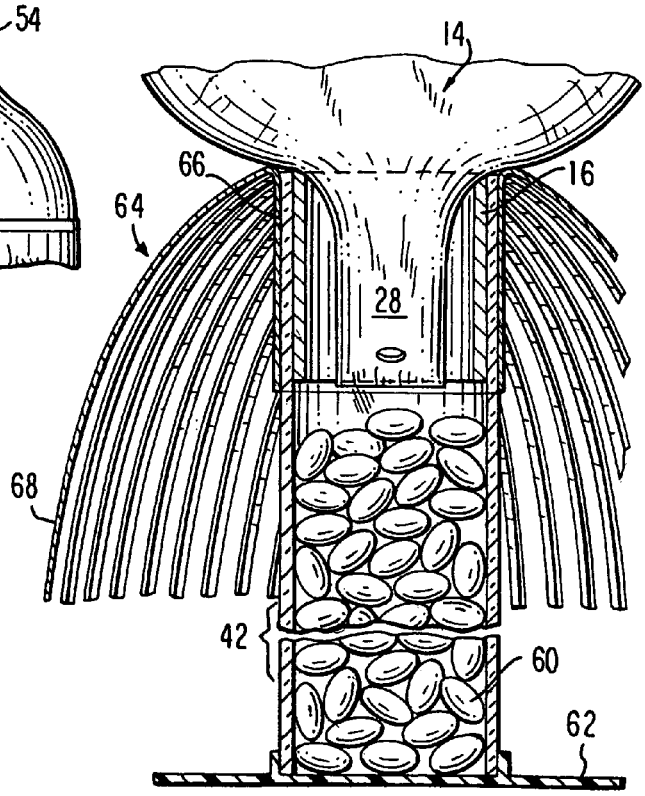
FIG. 8

BALLOON DISPLAY SYSTEMS

BACKGROUND OF THE INVENTION

1. Field of the Invention

The present invention generally relates to balloons, especially non-latex, foil balloons that are inflated with air and used in display systems as centerpieces and decorations for adornment purposes.

2. Description of the Related Art

Balloons are popular decorations and are widely sold, either collapsed or inflated, in two widely available forms, namely those made of a stretchable latex, and those made of non-stretchable, metallized films commonly known as "foil" balloons. Foil balloons are usually inflated with helium or air introduced into a relatively long neck or stem, and then sealed, for example, by tying the neck off with a tether, by clipping or crimping the neck, by heat sealing the neck closed, or by using a self-sealing valve. The sealed, inflated balloon is often supported or held by a funnel-shaped plastic cup provided at one end of a stick or plastic shaft, or is connected to a holder in order to attract attention. Patents representative of this art are exemplified by U.S. Pat. No. 4,661,081; No. 4,798,554; No. 5,306,194; No. 2,882,645; No. 5,036,985; No. 4,881,916; No. D-376,101; No. 3,892,081; and No. 5,989,093.

Experience has shown, however, that inflating foil balloons of large size, typically about eighteen inches and larger in diameter, with helium is not altogether satisfactory, because many retailers are unwilling to handle helium and to devote the labor required to fill the balloons. Some municipalities restrict sales of helium balloons over concern of damage to overhead power lines and communication systems. Even when such large balloons are filled with air, it is difficult to readily secure and hold the inflated balloon on the above-described funnel-shaped cup on a stick, not to mention the unaesthetic appearance of such a holder, or its restriction to hand-held usage.

SUMMARY OF THE INVENTION

Objects of the Invention

Accordingly, it is a general object of this invention to hold a balloon, especially an air-filled, foil balloon of large size, for use in displays as centerpieces and decorations.

More particularly, it is an object of the present invention to provide new uses for foil balloons.

Still another object of the present invention is to provide an inexpensive, easy to manufacture and assemble, balloon display system.

FEATURES OF THE INVENTION

In keeping with the above objects and others which will become apparent hereinafter, one feature of the present invention resides, briefly stated, in a balloon display system including a balloon having a neck, and a gas-admitting inlet on the neck for enabling the balloon in a deflated state to be inflated with a gas, for example, air or helium, to an inflated state. A tube is connected to the neck in the deflated state. The tube bounds an interior through which the neck extends. The tube has an open end for exposing the inlet for enabling inflation to the inflated state. The exposed inlet is also useful for reinflating the balloon in case there is an escape of the gas therefrom.

Hence, rather than connecting the balloon to a hand-held, funnel-shaped, stick-mounted cup, the balloon of this invention is connected to a tube. Advantageously, the tube is a hollow cylinder having inner and outer circumferential walls. In one embodiment, the tube is slidably inserted with frictional engagement into an upper, open tubular end portion of a container. In another embodiment, the tube is slidably mounted with frictional engagement around an upper cylindrical portion of a container.

As previously mentioned, the deflated balloon is connected to the tube. This enables a retailer to sell the deflated balloon and connected tube as a preassembled unit, for example, as part of a kit. This promotes impulse buying because a consumer need not be bothered with connecting the balloon to a connector, or with returning to the retailer to inflate the balloon, or with inflating the balloon days or weeks before the balloon is to be used. Instead, the exposed inlet is always ready to admit the gas. For example, an elongated, hollow conduit such as a straw is insertable through the open end of the tube and into the exposed inlet for conducting the gas, such as air blown in by a user, into the balloon. The straw is removable, and the escape of gas from the balloon is resisted by a self-sealing valve provided within the balloon.

Preferably, the neck of the deflated balloon is pulled taut through the interior of the tube, and the end portion of the neck, which extends beyond the tube, is connected, preferably by an adhesive, to the outer circumferential wall of the tube. The neck end portion could also be captured and held in a slit in the tube.

The container has an opaque or a light-transmissive sidewall, and preferably contains a product, for example, candy. The container may also contain non-edible items, such as a sound generator that, when activated, plays a recorded song, for example. The container may also contain a motor for turning the tube and the balloon relative to the container, as well as beverages, non-alcoholic or alcoholic. Decorative elements may also be mounted on the tube for additional ornamentation.

Thus, in accordance with one aspect of this invention, the tube connected to the balloon serves as a convenient balloon holder, which does not interfere with inflating the balloon. The tube can easily be slipped over the top of a liquor or wine bottle, thereby making an attractive gift presentation. The tube can also be slid into the top of a tubular container, thereby making an attractive centerpiece.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a broken-away, elevational view of an inflated balloon connected to a split tube and mounted on the top of a broken-away bottle;

FIG. 7 is an enlarged, sectional view taken on line 7-7 of FIG. 6;

FIG. 8 is a view analogous to FIG. 4, with a decorative element and a support base, especially useful as a centerpiece;

DETAILED DESCRIPTION OF THE PREFERRED EMBODIMENTS

Figure 1:
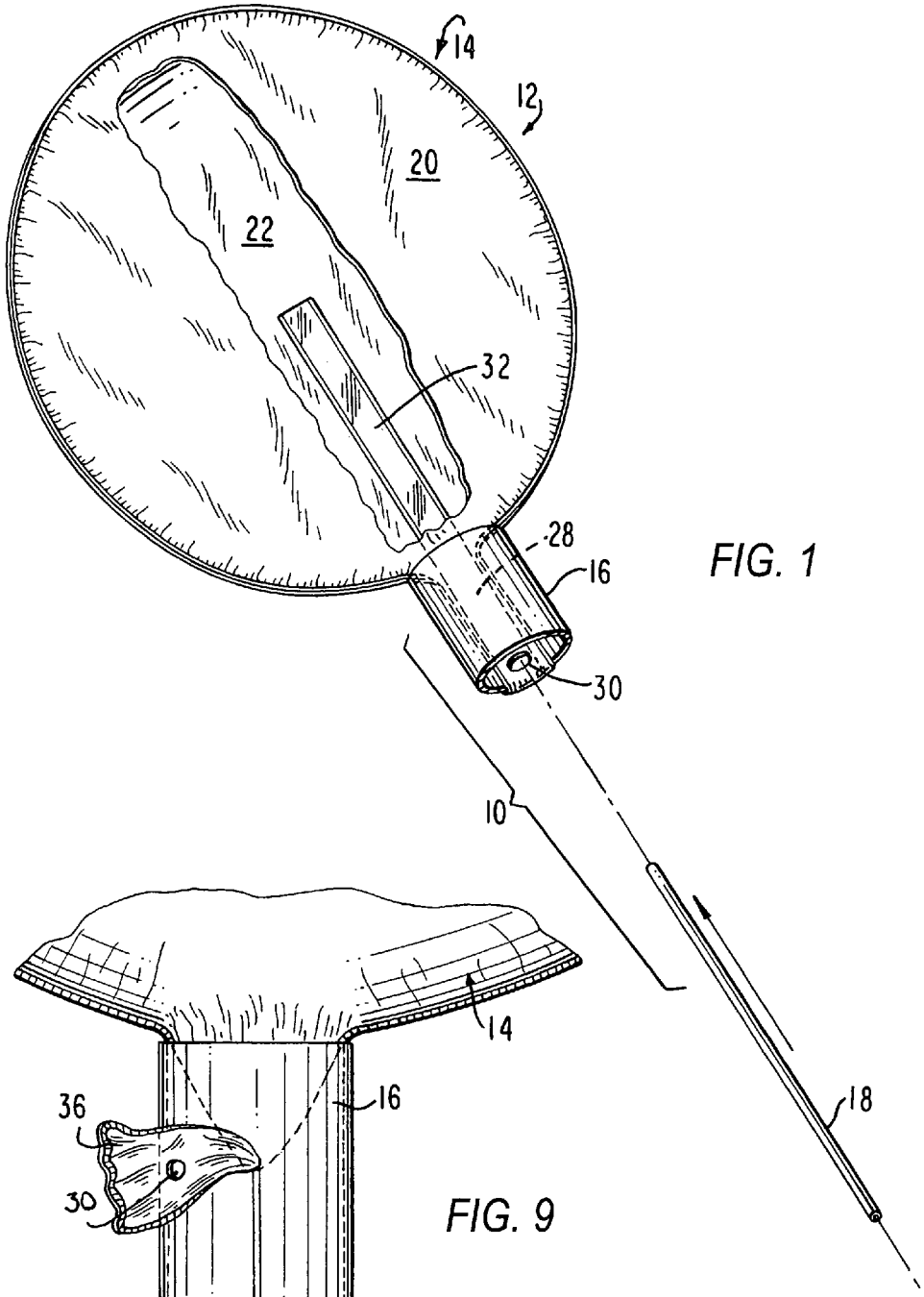
FIG. 1 is an exploded, perspective view of a straw for insertion into an inlet of a deflated balloon connected to a tube in accordance with this invention, the balloon being cut-away to show a self-sealing valve therein.

Referring now to the drawings, reference numeral 10 identifies a combination of a pre-assembled unit 12 comprised of a deflated balloon 14 connected to a tube 16, and a hollow elongated conduit, for example, a straw 18 used, as described below, to inflate the balloon 14. The balloon 14 is preferably made of foil and includes a pair of juxtaposed, metallized films 20, 22, preferably of circular shape, peripherally sealed to bound an interior. Each film 20, 22 has integral stems 24, 26 (see FIG. 4) together constituting an elongated neck 28 on which a gas-admitting inlet 30 is formed. Shapes, other than circular for the films, can also be employed. Although the balloon 14 may have any diameter, it is preferred that the balloon diameter be eighteen inches or larger.

A pair of juxtaposed, elongated valve strips 32, 34 (see FIG. 4) is sealed along their longitudinal edges to bound a passage in gaseous communication with the inlet 30. The strips 32, 34 are generally planar, are in surface area contact with each other, and are captured between the films 20, 22 within the balloon. The valve strips 32, 34 function as a self-sealing valve, as described below.

Figure 2:
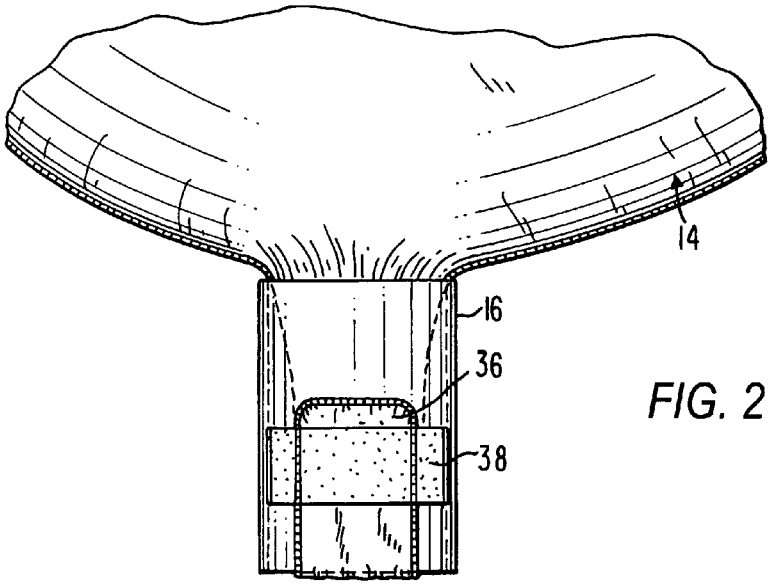
FIG. 2 is a broken-away elevational view of an inflated balloon connected to the tube of FIG. 1.

The tube 16 is a hollow cylinder having inner and outer circumferential walls, as well as opposite, open axial ends. The tube 16 can be made of any material, cardboard being preferred. The unit 12 is pre-assembled by passing the neck 28 of the deflated balloon through at least one of the open axial ends of the tube, and connecting the neck 28 to the tube. This can be accomplished in various ways. For example, as shown in FIGS. 1-5, the neck 28 is pulled through the opposite open axial end of the tube through the hollow interior thereof, and the end region 36 of the neck 28, which extends beyond the tube, is folded and secured to the outer circumferential wall of the tube, preferably with an adhesive. As shown in FIG. 2, an adhesive tape 38 is applied over the neck end region 36 and the outer circumferential wall of the tube 16. Alternatively, a double-sided adhesive tape could be applied between the outer wall of the tube and the neck end region. An adhesive layer could also be pre-applied on at least one of the outer tube wall and the neck end region, preferably the adhesive layer being covered by a peelable protective cover.

Figure 3:
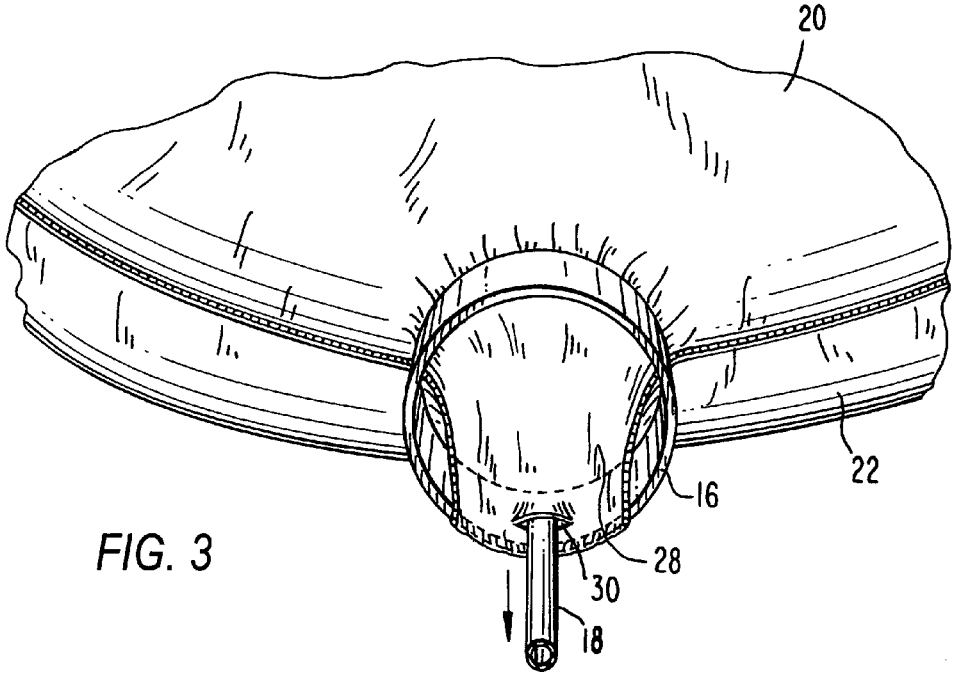
FIG. 3 is a broken-away, perspective view depicting the removal of the straw from the inlet of the inflated balloon of FIG. 2.

In a preferred embodiment, after the neck is secured to the tube, the inlet 30 is exposed. As shown in FIG. 1, the straw 18 is easily inserted into the exposed inlet and into the passage between the valve strips 32, 34. Air can be blown, by mouth, into the straw and through the valve strips 32, 34 into the interior of the balloon to inflate the same. Once the balloon is inflated, the straw is easily removed, as shown in FIG. 3, from the exposed inlet 30. The air pressure within the inflated balloon presses the valve strips 32, 34 together into planar sealing contact, thereby resisting escape of the gas from the inflated balloon. Should gas, however, escape, then the straw may be reintroduced into the exposed inlet through the valve strips 32, 34 into the interior of the balloon to reinflate the same.

Figure 9:
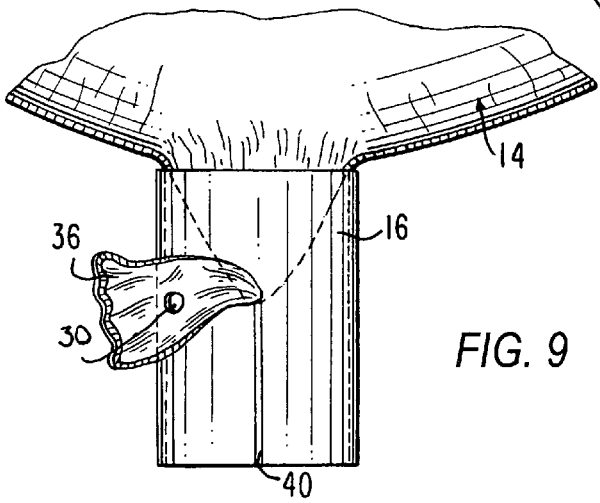
FIG. 9 is a view analogous to FIG. 2, but of another embodiment.

Although the use of a self-sealing valve is preferred, the balloon can, for example, be inflated first, then heat-sealed, and thereafter connected to the tube. FIG. 9 depicts a view analogous to FIG. 2, wherein the neck end region 36 is wedged and held inside a slit 40 formed in the tube 16 to form the pre-assembled unit. In the embodiment of FIG. 9, the exposed inlet 30 can be situated inside or outside the tube and, as shown, is outside the tube. The neck end region 36 can be left to hang free, or can be adhesively secured to the outer circumferential wall thereof.

Figure 4:
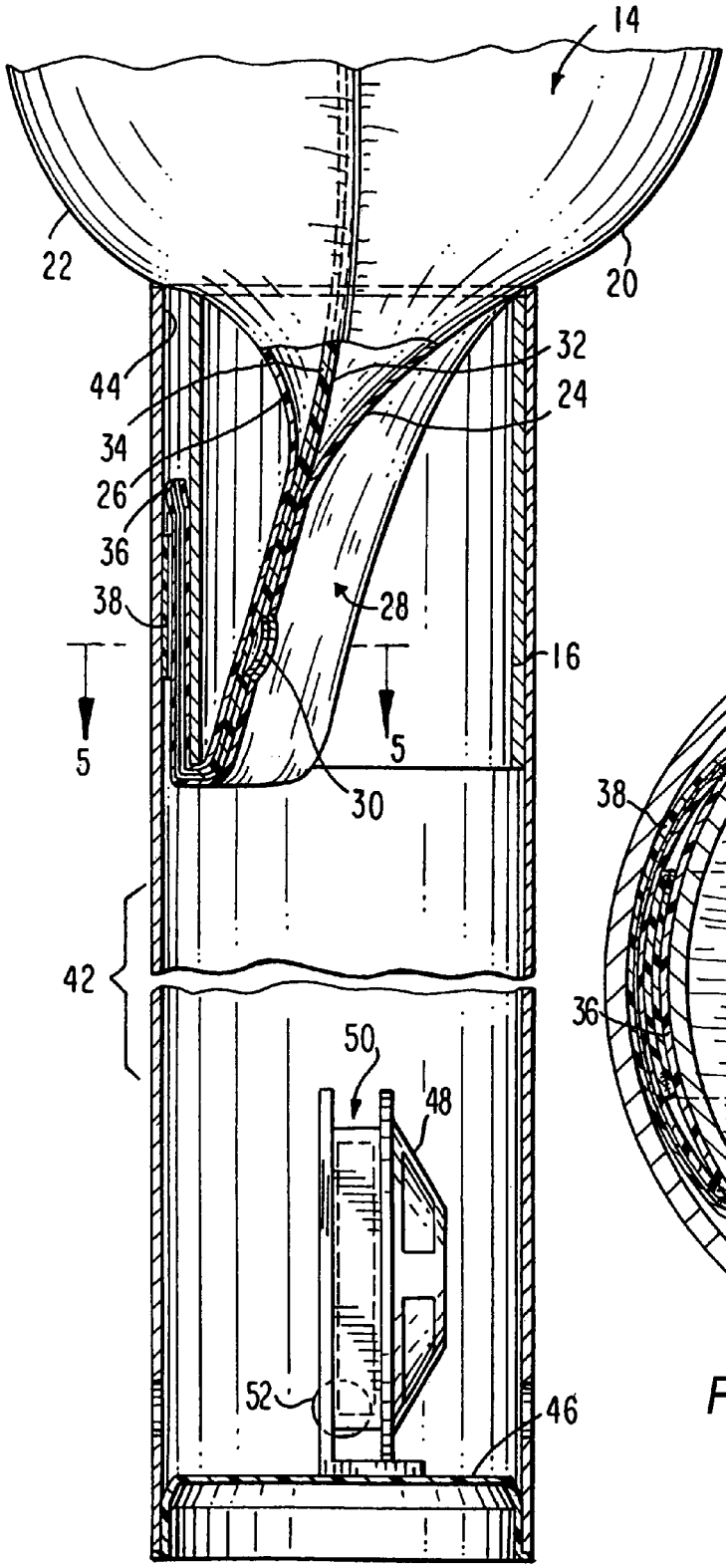
FIG. 4 is a broken-away, sectional view of the inflated balloon and tube of FIG. 2 mounted on the top of an upright container.
Figure 5:
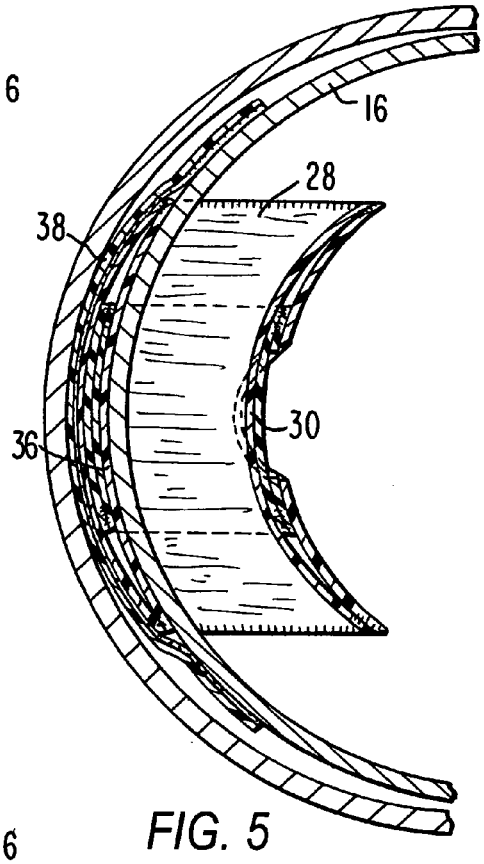
FIG. 5 is a broken-away, enlarged sectional view taken on line 5-5 of FIG. 4.

The pre-assembled unit 12 is mounted on a container to constitute a balloon display system. As shown in FIG. 4, the container 42 is cylindrical and has an open top 44 and a closed bottom 46. The tube 16 is slidably inserted into the open top 44 and frictionally retained therein. The sidewall of the container 42 may be light-transmissive or opaque as shown. The container may hold a product, for example edible items such as candies or jellybeans, or non-edible items such as toys.

In FIG. 4, the container 42 contains a music or sound module 50, analogous to that described in U.S. Pat. No. 6,482,065 and No. 6,821,183. The module 50 is powered by a battery and includes a microchip for actuating a speaker 48. The module 50 is mounted on the closed bottom 46, and the sound generated by the module is amplified and resonated by the container and travels through the tube 16, thereby allowing the films of the bottom to vibrate and enhance the musical presentation, for example, a song memorializing a social event such as a birthday. Air holes 52 are used to allow the sound to be heard more loudly. Preferably, the closed bottom 46 is weighted to prevent the container from tipping.

FIG. 6 depicts a different type of container on which the pre-assembled unit is mounted. This container is a liquor or wine bottle 54 having a cylindrical top 56 closed by an inner cork or an outer cap. The tube 16 is slid over and around the closed top 56, as shown in FIG. 7. Since different bottles 54 have cylindrical tops of different diameters, the tube 16 is advantageously provided with an axial slot 58 to permit the tube 16 to expand to accommodate such different sizes. The slotted tube 16 thus acts as a clip to resiliently hold the pre-assembled unit on the bottle 54.

FIG. 8 is analogous to FIG. 4 in that both depict the pre-assembled unit mounted on and within an open top of a cylindrical container 42. In the case of FIG. 8, however, the sidewall of the container 42 is light-transmissive to enable the product therein, in this case, jellybeans 60, to be seen. The jellybeans can be packed in a transparent bag (not illustrated).

Since the container 42 is relatively tall and narrow, a support base 62 is advantageously fitted on the bottom of the container to resist tipping. The support base 62 is preferably weighted. For increased adornment, a decorative element 64 is mounted on the container, especially in the region of the tube 16 to at least partially conceal the same from view. As shown, the decorative element 64 includes a sleeve 66 axially slidable lengthwise of the container 42 and frictionally retained in any selected position, for example, in the circumambient region of the tube 16, and a multitude of decorative strips 68 each extending downwardly along a curved arc. Other decorative elements are contemplated. A plurality of the same or different decorative elements may be located at different heights above the base 62.

Thus, in accordance with this invention, a foil balloon, even of large size, can be filled with air, helium or other gas, and, after being connected to a tube, can be easily and effectively used as centerpieces (e.g., FIG. 4 or FIG. 8), or gifts (e.g., FIG. 6). This opens up many new retail outlets to foil balloons, and provides many new uses for such balloons.

The exposed inlet 30 can be used for the initial inflation of the balloon, or for subsequent refills. The balloon is preferably, but need not be, pre-attached to the tube. The balloon is preferably a foil balloon, but could also be a latex balloon. For additional adornment, light emitting diodes may be provided on the container. In a retail environment, a purchaser can select and mix and match among different balloons, containers, and products for placement inside the containers. The purchaser can buy a pre-assembled unit with a deflated balloon, and then inflate the balloon at home prior to the presentation of the item decorated by the balloon display system of this invention.

Figure 11:
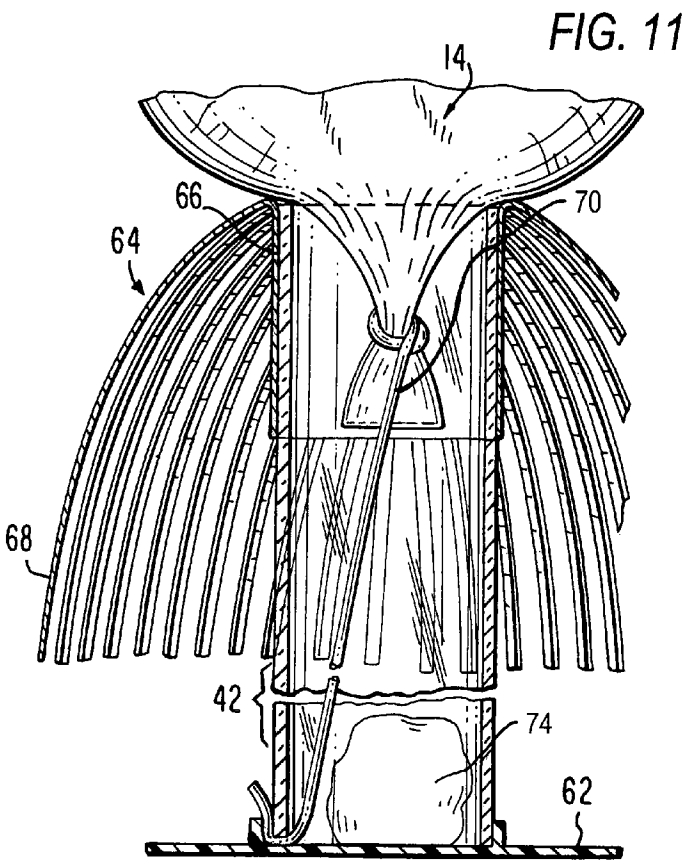
FIG. 11 is a view analogous to FIG. 8, but with a tether for connecting the balloon.

In still another variation as shown in FIG. 11, the balloon is inflated and tied off by a string, ribbon or like tether 70, in which case, the tether is passed through at least one of the open ends of the container, and thereupon secured, for example, by being wedged between the container and the base 62. A weight 74 can advantageously be positioned within the container.

Figure 10:
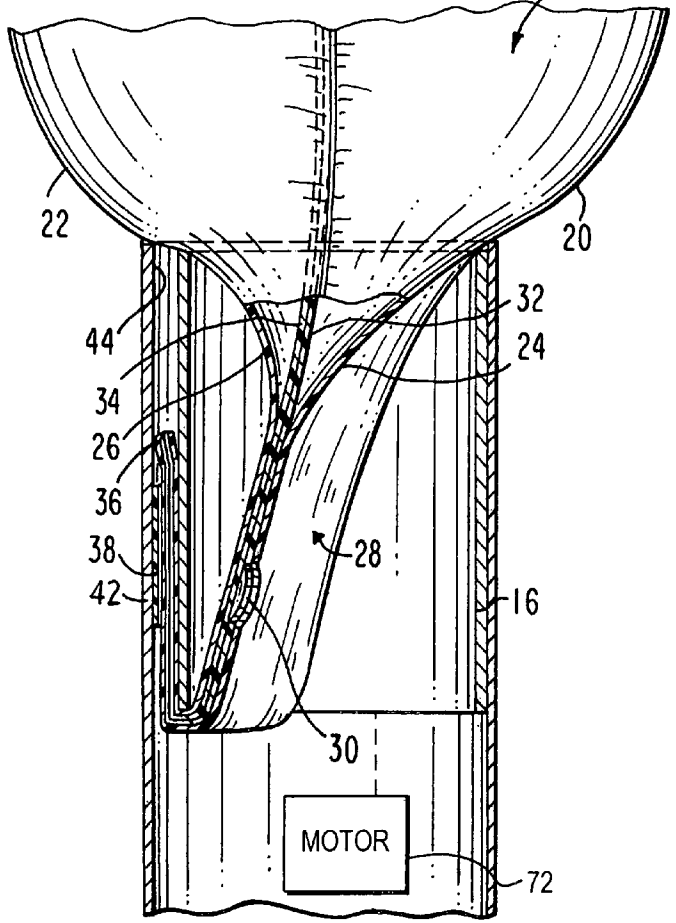
FIG. 10 is a view analogous to FIG. 4, with a motor for turning the balloon.

Motion can be added to the system by using a low voltage, DC motor 72, as shown in FIG. 10, or an AC motor, to cause the balloon and the tube to rotate relative to the container.

It will be understood that each of the elements described above, or two or more together, also may find a useful application in other types of constructions differing from the types described above.

While the invention has been illustrated and described as embodied in balloon display systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A balloon display system, comprising:

a) a balloon having a neck terminating in a closed end portion, and a gas-admitting inlet on the neck and spaced away from the closed end portion for enabling the balloon in a deflated state to be inflated to an inflated state;

b) a tube connected to the neck in the deflated state of the balloon, the tube bounding an interior through which the neck extends, the tube having an open end for exposing the inlet for enabling inflation to the inflated state; and c) a valve within the balloon for resisting escape of gas through the inlet.

2. The system of claim 1, wherein the balloon includes juxtaposed films peripherally sealed to bound an interior, and wherein the valve is a self-sealing valve within the interior of the balloon, the valve being open in the deflated state and in gaseous communication with the inlet to enable the inflation to the inflated state, and the valve being closed in the inflated state to resist escape of gas through the inlet.

3. The system of claim 2, wherein the valve includes juxtaposed, elongated valve strips bounding a passage in gaseous communication with the inlet.

4. The system of claim 2, wherein the tube is a hollow cylinder having an inner circumferential wall and an outer circumferential wall, and wherein the neck is pulled taut through the interior of the tube and wherein the closed end portion is connected to the tube at the outer circumferential wall of the cylinder.

5. The system of claim 4, wherein the closed end portion is connected to the outer circumferential wall by an adhesive.

6. The system of claim 4; and a container having an upper, open tubular end portion into which the tube is slidably inserted with frictional engagement.

7. The system of claim 6, wherein the container holds a product and has a light-transmissive side wall through which the product is visible.

8. The system of claim 6, wherein the container holds a sound generator and has openings in a side wall to enable sound to pass through the openings.

9. The system of claim 6, wherein the closed end portion is captured between the outer circumferential wall of the cylinder and the tubular end portion of the container.

10. The system of claim 6; and a decorative element at the upper, open tubular end portion of the container.

11. The system of claim 6; and a support base at a lower, tubular end portion of the container for supporting the container in an upright orientation.

12. The system of claim 6, wherein the container holds a motor operatively connected to the tube for turning the tube.

13. The system of claim 4; and a container having an upper cylindrical portion around which the tube is slidably mounted with frictional engagement.

14. The system of claim 13, wherein the tube is circumferentially incomplete.

15. The system of claim 13, wherein the neck within the tube is captured between the cylindrical portion of the container and the inner circumferential wall of the cylinder.

16. The system of claim 1; and an elongated, hollow conduit insertable through the open end of the tube and into the exposed inlet for conducting a gas into the balloon.

17. A balloon display system, comprising:

a) a foil balloon including juxtaposed films peripherally sealed to bound an interior, an elongated neck terminating in a closed end portion, an air-admitting exposed inlet on the neck and spaced away from the closed end portion for enabling the balloon in a deflated state to be inflated to an inflated state, and a self sealing valve within the interior of the foil balloon, the valve being open in the deflated state and in air communication with the exposed inlet to enable air inflation to the inflated state, and the valve being closed in the inflated state to resist escape of air through the exposed inlet;

b) a hollow cylindrical tube for contacting and holding the foil balloon in the inflated state, the tube having an inner cylindrical wall and an outer cylindrical wall, the tube bounding an interior into and out of which the neck is pulled taut, the neck being folded onto the outer cylindrical wall, the closed end portion being connected at the outer cylindrical wall; and c) a container having an upper cylindrical portion at which the tube is mounted with the balloon in the inflated state.

18. The system of claim 17, wherein the upper cylindrical portion of the container is open and hollow, and wherein the tube is slidably inserted into the open, hollow, upper cylindrical portion with frictional engagement.

19. The system of claim 17, wherein the upper cylindrical portion of the container is closed, and wherein the tube is slidably inserted around the upper cylindrical portion with frictional engagement.

20. A balloon display system, comprising:

a) a foil balloon including juxtaposed films peripherally sealed to bound an interior, an elongated neck terminating in a closed end portion, an air-admitting exposed inlet on the neck and spaced away from the closed end portion for enabling the balloon in a deflated state to be inflated to an inflated state, and a self-sealing valve within the interior of the foil balloon, the valve being open in the deflated state and in air communication with the exposed inlet to enable air inflation to the inflated state, and the valve being closed in the inflated state to resist escape of air through the exposed inlet;

b) a hollow container for supporting the balloon in the inflated state; and c) a tether connected to the neck in the inflated state of the balloon, the tether extending through an interior of the hollow container and holding the balloon in contact with the container.

21. A method of displaying a balloon, comprising the steps of:

a) connecting a neck of the balloon in a deflated state to a tube by extending the neck through an interior of the tube;

b) exposing a gas-admitting inlet on the neck at an open end of the tube to enable the balloon to be inflated to an inflated state; and c) supportably mounting the tube with the connected balloon in the inflated state at an upper region of a container.

22. A balloon display system, comprising:

a) a foil balloon including juxtaposed films peripherally sealed to bound an interior, an elongated neck terminating in a closed end portion, an air-admitting exposed inlet on the neck and spaced away from the closed end portion for enabling the balloon in a deflated state to be inflated to an inflated state, and a self-sealing valve within the interior of the foil balloon, the valve being open in the deflated state and in air communication with the exposed inlet to enable air inflation to the inflated state, and the valve being closed in the inflated state to resist escape of air through the exposed inlet; and b) a hollow tube for contacting and holding the foil balloon in the inflated state, the tube having an inner wall and an outer wall, the tube bounding an interior into and out of which the neck is pulled taut, the neck being folded onto the outer wall, the closed end portion being connected at the outer wall.

23. A method of displaying a balloon, comprising the steps of:

a) peripherally sealing juxtaposed films to bound an interior of a foil balloon having an elongated neck terminating in a closed end portion;

b) exposing an air-admitting inlet on the neck at a location spaced away from the closed end portion for enabling the balloon in a deflated state to be inflated to an inflated state;

c) providing a self-sealing valve within the interior of the foil balloon, the valve being open in the deflated state and in air communication with the exposed inlet to enable air inflation to the inflated state, and the valve being closed in the inflated state to resist escape of air through the exposed inlet;

d) contacting and holding the foil balloon with a hollow tube in the inflated state, and configuring the tube with an inner wall, an outer wall, and an interior;

e) pulling the neck taut into and out of the interior of the tube, and folding the neck beyond the tube onto the outer wall; and f) connecting the closed end portion at the outer cylindrical wall.

* * * * *